United States Patent [19]

Whitley

[11] 4,046,363

[45] Sept. 6, 1977

[54] PIPE CLAMPING TOOL ASSEMBLY

[76] Inventor: Gerald E. Whitley, P.O. Box 103, Bell Arthur, N.C. 27811

[21] Appl. No.: 645,840

[22] Filed: Dec. 31, 1975

[51] Int. Cl.[2] ..... B25B 1/14

[52] U.S. Cl. ..... 269/228; 269/236

[58] Field of Search ..... 269/236, 228

[56] References Cited

U.S. PATENT DOCUMENTS

| | | | |
|---|---|---|---|
| 433,978 | 8/1890 | Corning et al. | 269/236 |
| 687,177 | 11/1901 | Caldwell | 269/236 |
| 1,055,552 | 3/1913 | Payne | 269/236 |

*Primary Examiner*—Al Lawrence Smith
*Assistant Examiner*—Robert C. Watson
*Attorney, Agent, or Firm*—Mills & Coats

[57] ABSTRACT

The present invention relates to a pipe clamping tool assembly that may be extended to an open position such that a portion of a pipe may be laid across a lower first member, after which said pipe clamping tool assembly may be folded to a closed position wherein a second member overlies the inserted pipe and is aligned directly over said lower first member, and by actuating a lever arm the second member is engaged and pressed downwardly such that said second member and said first member cooperate to squeeze and compress the pipe so as to clamp the same and effectively close the pipe and prevent fluid from passing through the clamped area.

4 Claims, 4 Drawing Figures

PIPE CLAMPING TOOL ASSEMBLY

The present invention relates to hand tools and more particularly to a hand actuated pipe tool for clamping and effectively closing pipes, tubes and the like.

BACKGROUND OF THE INVENTION

In community water systems, one finds a main water line having a series of service branch lines that run from the main water line, through a water meter, to a customer's dwelling. Today, it is quite common for the service branch lines leading from the main water line to the customer's dwelling to be manufactured of a plastic-like tubing. One of the most troublesome problems that is encountered in such water systems is that sometimes a service branch line will be inadvertently cut by a backhoe, or other type of grading or excavating machine, or will simply develop a leak. To repair the service branch lines, it is common practice to cut the service branch line and to install a coupling across the respective ends of the cut line such that the coupling covers the area of rupture or the area where the water is leaking from the service branch line. But the real problem is that to install the repair coupling, one must stop the flow of water in the service branch line.

Today the common practice for stopping the flow of water in such lines, is after cutting the branch line then a portion of the end of the segment extending from the main water line is bent back to the extent that the line is pinched and effectively closed. The portion of the line that is bent back then extends upwardly in some cases as much as one or two feet, and the coupling must be placed about the uppermost end of the bent portion and then curved back to the other end of the cut branch line so as to couple the two cut ends. The net effect, is that the repair coupling may extend as much as five feet and the extension is often awkward and undesirable in that that portion of the branch line now comprising the repair coupling does not extend straight but may be curved and wound and often will extend above the level of the ordinary path of the branch service line. Consequently, then the repairing of such a line is quite awkward and does not result in a clean and neat repair segment that extends in line with the other portions of the service branch line.

In addition, it is appreciated that in repairing such a line as discussed above, just after the line is cut, the water therein gushes from the end extending from the main water line and continues to gush and rush outwardly therefrom until a portion of that line is bent back to a crooked position. In the meantime, the repairman is likely to be doused with water.

SUMMARY OF THE INVENTION

The present invention relates to a small and relatively simple pipe clamping tool that is adapted to be used in repairing fluid lines such as the branch service lines discussed above. The pipe clamping tool of the present invention is adapted to be placed around a portion of a pipe, such as a plastic tube-like pipe, and by actuating the same to compress a portion of the pipe to a clamped position, thereby effectively closing the pipe. In the case of repairing a service branch water line as discussed above, the pipe tool assembly of the present invention would be placed at a position adjacent the area to be cut on the side nearest the main water line. By clamping the service branch line at this point, the water flow from the main water line is cut off at the clamping point, and the service water line (or branch service line) can be cut and a relatively short repair coupling can be placed over the area to be repaired without the problems and inconveniences as outlined above. In particularly, after the repair coupling has been secured in place between the two cut ends, it is appreciated that the branch service line still remain relatively straight because by using the clamping tool of the present invention there is no longer any need to bend a portion of the service line extending from the main water line back to a crimped position. Once the repair coupling is properly placed between the two cut ends, the pipe clamping tool assembly of the present invention is removed and the area previously dug out is filled and the repair is complete.

It is, therefore, an object of the present invention to provide a relatively simple, and easy to operate pipe clamping tool that is adapted to clamp and effectively close a water pipe or the like such that fluid may not flow pass the clamped area.

Still a further object of the present invention is to provide a relatively small hand actuated pipe clamping tool assembly that does not require a substantial or large dug out ground area for use.

Another object of the present invention is to provide a tool clamping assembly that is foldable between open and closed position wherein in the open position said tool clamping assembly is generally elongated and is open at the top sufficient enough that the entire tool clamping assembly may be slipped under a portion of a pipe and then folded to a closed position where the same may be actuated to compress the pipe lying therein to effectively close the same.

Another object of the present invention is to provide a tool clamping assembly that is adapted for use by those repairing water lines and which is effective to close the pipes such that the flow of water therethrough is stopped in the area in which the clamp is positioned.

Other objects and advantages of the present invention will become apparent from a study of the following description and the accompanying drawings which are merely illustrative of the present invention.

DESCRIPTION OF PREFERRED EMBODIMENT

Figure 1:
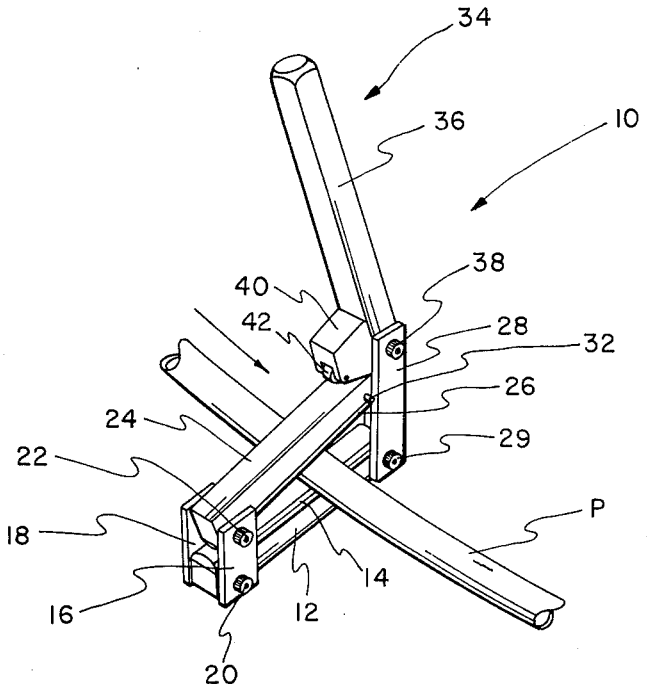
FIG. 1 is a perspective view of the pipe tool clamping assembly of the present invention, shown with the lever means thereof being in a general upright position just prior to actuating the tool assembly into a clamped position.
Figure 2:
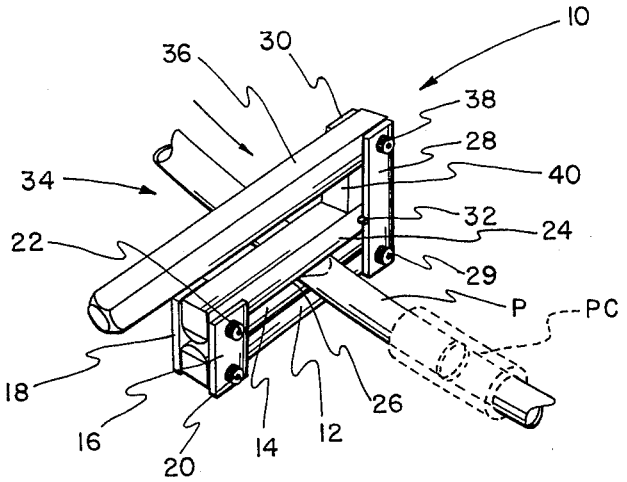
FIG. 2 is another perspective view of the pipe clamping tool assembly of the present invention, the tool clamping assembly being disposed in the closed or clamped position.

With further reference to the drawings, particularly FIGS. 1 and 2, the pipe clamping tool assembly of the present invention is shown therein and indicated generally by the numeral 10. Viewing the pipe clamping tool assembly 10 in greater detail, it is seen that the same comprises a first lower member 12 that includes an upper arcuate shaped bead 14 that extends substantially along the length thereof. Secured to one end of said first member 12 is arm means in the form of plates 16 and 18 that are secured to the first member by a pivot pin assembly 20 that extends through the first member 12 and on through the plates 16 and 18.

Pivotably secured about an upper portion between said plates 16 and 18 is a second member 24 that is pivotably secured between plates 16 and 18 by another pivot pin assembly 22.

As with the case of the first member 12, said second member 24 includes an arcuate shape lower bead 26 that extends along one side thereof substantially from one end to the other end of said second member. Consequently, it is seen that the second member 24 is swingable with respect to said first member 12 from an outer position to a closed or clamping position in which case the second member 24 generally overlies the first member 12. As particularly illustrated in the drawings, the arcuate shaped bead layers 14 and 26 are so disposed that in the closed position, they generally face each other and as will become apparent from subsequent portions of this disclosure, the arcuate shaped bead areas 14 and 26 actually engage a pipe P that extends therebetween during the pipe clamping process.

Continuing to refer to the drawings, it is seen that opposite plates 16 and 18, there is a second arm means in the form of plates 28 and 30 that are secured to the end of the first member opposite the end where plates 16 and 18 are secured. In particular, plates 28 and 30 are generally upstanding and laterally spaced apart with the same being secured to the lower first member 12 by a pivot pin assembly 29. Pivot pin assembly 29 is so secured that plates 28 and 30 may pivotably move about the axis thereof and with respect to the first member 12.

Figure 3:
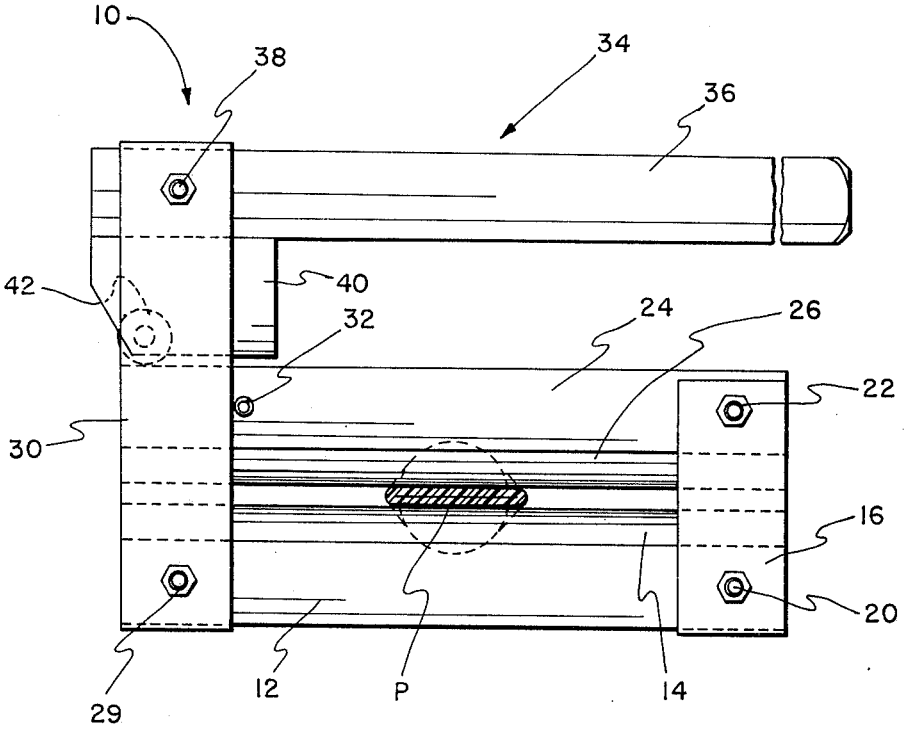
FIG. 3 is a side elevational view of the pipe clamping tool assembly with the same disposed in the clamped position.
Figure 4:
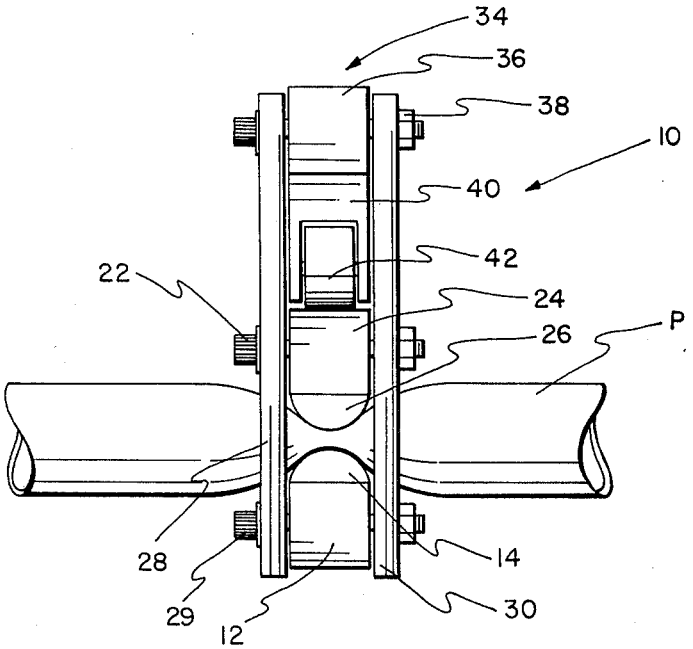
FIG. 4 is an end elevational view of the pipe clamping tool assembly of the present invention as disposed in the closed or clamped position and particularly illustrating the manner in which the cross sectional area of the pipe or tube therein is squeezed and compressed to close the same.

It should be pointed out that said second member 24 includes a pair of stops 32, each stop projecting outwardly from a respective side of said second member 24 and particularly positioned with respect to plates 28 and 30 so as to limit the clockwise movement thereof (as viewed in FIG. 3) when the pipe clamping tool assembly is actually actuated as a pipe or tubing member is clamped.

Pivotably connected about an upper portion of said plates 28 and 30 and supported therebetween is a lever means indicated generally by the numeral 34. The lever means 34 comprises a lever arm 36 that is generally elongated, and formed about the lower surface thereof in the vicinity of the pivot pin 38 that extends through the plates 28 and 30 and connects the lever arm 36 thereto, is a locking block 40 that as particularly illustrated in the drawings includes a roller 42 rotatively mounted about the lower leading edge thereof.

In operation, to clamp a pipe P, and assuming that if the pipe P is underground that the earth therearound has been sufficiently dug out, the pipe clamping tool assembly 10 of the present invention is opened such that the second member 24 is pivoted to a position outwardly of the lower member 12. It is preferable that the top area of the first member 12 be opened and to accommodate such, it is contemplated that plate 28 and 30 and the lever means 34 carried thereby is likewise pivoted to a position outwardly of the end of the first member 12. To clamp the pipe P, the pipe clamping tool 10 is placed underneath the pipe such that the lower portion of the pipe P overlies the upper arcuate shaped bead edge 14 of the first member 12. Next, the second member 24 is pivoted from its outer open position to a position that generally overlies the pipe P and the lower first member 12 (as viewed in FIG. 1). Then plates 28 and 30 are swung towards the end of said second member 24 as viewed in FIG. 1, and the repairman or user engages the lever arm 36 and rotates the same about the axis of the pivot arm 38 towards the second member 24. In so rotating the lever arm 36, the roller 42 engages an upper portion of the second member 24 and the locking block 40 is urged into a locked position (FIG. 2). In effect, the locked position is maintained in that the roller moves "over center" and the pipe clamping tool is securedly locked and will maintain itself in that mode due to the geometry of the lever arm, pivot pin assembly 38, locking block 40, and roller 40.

The pressure of the roller 40 causes the upper member 24 to compress the portion of the pipe P disposed between the arcuate shaped bead layers 26 and 14 such that the pipe portion therebetween is effectively closed. In use, the pipe P is clamped thereby cutting off the flow of fluid or water through the area clamped by the pipe clamping tool assembly 10 of the present invention. As viewed in FIG. 2, the pipe portion to be repaired is to the right of the tool assembly 10, and repair is accomplished by cutting pipe P and placing a pipe coupling PC over the two cut ends. Details of securing the pipe coupling PC across the ends are not disclosed herein as such is a common practice in repairing pipes of all types, including plastic type tubing. But it should be pointed out that the pipe coupling PC would extend across the respective cut ends of the pipe a length sufficient to cover all of the ruptured or damaged areas of the pipe. The pipe clamping tool assembly 10 of the present invention can be used as discussed above in repairing branch service lines in community water systems as discussed in the Background of the Invention preceding the Description of the Preferred Embodiment.

Although the pipe coupling tool assembly 10 of the present invention may be used for various types of pipes, it is particularly contemplated that the same would be especially useful in connection with plastic type pipes. In use, to dismantle the pipe clamping assembly 10 from the pipe P, the user engages the lever arm 36, and as viewed in FIG. 3, pivots the same counterclockwise causing the roller 42 to move to the right and to release the pressure on the left end of the second member 24. After this, the repairman or user can simply swing the second member 24 to the right, as viewed in FIG. 3, and remove the pipe clamping tool assembly 10 from around the pipe P. Because of the nature of the plastic type pipe P, as discussed herein, the clamp portion or closed area of the pipe will return to its normal shape and water may flow freely therethrough.

From the foregoing discussion, it is seen that the pipe clamping tool assembly 10 of the present invention is relatively simple to operate, compact in design, and particularly adapted to be used in cramped or close areas in the clamping of tubes and the effective closing of the same. Although the pipe clamping tool assembly 10 of the present invention may be constructed of various size, shapes and types of material, it is contemplated that a substantial portion of the structure would be constructed of heavy duty metals.

The terms "upper", "lower", "forward", "rearward", etc., have been used herein merely for the convenience of the foregoing specification and in the appended claims to describe the pipe clamping tool assembly and its parts as oriented in the drawings. It is to be understood, however, that these terms are in no way limiting to the invention since the pipe clamping tool assembly may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A pipe clamping tool assembly for clamping and effectively closing a pipe or the like, comprising: a generally elongated first member having an arcuate shaped upper pipe receiving surface for receiving a portion of a pipe to be clamped; first and second arm means secured to opposite portions of said first member and extending therefrom; a generally elongated second member having an arcuate shaped lower pipe engaging surface formed thereon and movably mounted to said first arm means and movable back and forth between a first pipe loading position where a pipe or a portion thereof can be easily placed adjacent the upper engaging surface of said first member and a second pipe clamping position generally overlying said first member such that in operation a pipe receiving area is defined between said first and said second members and the pipe to be clamped or a portion thereof is disposed between said first and second members; and pipe clamping lever means movably mounted to said second arm means and movable with respect thereto for engaging said second member and for pressing the same downwardly towards said first member such that said pipe or portion thereof lying in said defined pipe receiving area between said first and second members is clamped and effectively closed about the area thereof lying between said first and second members, said lever means having a pressing portion that includes a roller rotatively mounted in association therewith so as to engage a portion of said second member during the clamping operation and to press thereagainst as said lever means is actuated by pivoting the same towards said second member.

2. The pipe clamping tool assembly of claim 1 wherein said first and second arm means are aligned with said first and second members and wherein said second arm means having said pipe clamping lever means movably mounted thereto extends above the upper level of said second member when said second member is disposed in said second pipe clamping position; and wherein said second arm means includes an open area for allowing an end portion of said second member opposite the end that is secured to said first arm means to pass therethrough as said second member is pressed against a pipe or portion thereof during the pipe clamping operation.

3. The pipe clamping tool assembly of claim 2 wherein said second member includes stop means associated therewith for engaging said second arm means for limiting the downward movement of said second member.

4. A pipe clamping tool assembly for clamping and effectively closing a pipe or the like, comprising: a generally elongated first member having an arcuate shaped upper pipe receiving surface for receiving a portion of a pipe to be clamped; first and second arm means secured to opposite portions of said first member and extending therefrom with both said first and second arm means each including a pair of spaced apart plates secured about opposite sides to said first member; a generally elongated second member having an arcuate shaped lower pipe engaging surface formed thereon and movably mounted to said first arm means and movable back and forth between a first pipe loading position where a pipe or a portion thereof can be easily placed adjacent the upper engaging surface of said first member, and a second pipe clamping position generally overlying said first member such that in operation a pipe receiving area is defined between said first and said second members and the pipe to be clamped or a portion thereof is disposed between said first and second members; and pipe clamping lever means movably mounted to said second arm means and movable with respect thereto for engaging said second member and for pressing the same downwardly towards said first member such that said pipe or portion thereof lying in said defined pipe receiving area between said first and second members is clamped and effectively closed about the area thereof lying between said first and second members, and wherein said pipe clamping lever means is pivotably connected by a transverse axis across the respective plates of said second arm means and includes a locking block disposed generally adjacent the pivot axis thereof and wherein roller means is rotatively mounted within said locking block for engaging an upper surface of said second member during the pipe clamping operation such that said second member is pressed against the underlying pipe or portion thereof until said locking block and roller means are disposed in an over center locking relationship relative to said second member and the pivot axis of said pipe clamping lever means.

* * * * *